US006012615A

United States Patent [19]

Brunet et al.

[11] Patent Number: 6,012,615

[45] Date of Patent: Jan. 11, 2000

[54] PRECOMPRESSION PUMP FORMED WITHIN THE PUSHER ELEMENT

[75] Inventors: Michel Brunet, Plouaret; Olivier de Pous, Paris, both of France

[73] Assignee: Valois S.A., Le Neubourg, France

[21] Appl. No.: 09/091,900

[22] PCT Filed: Nov. 29, 1996

[86] PCT No.: PCT/FR96/01895

§ 371 Date: Aug. 17, 1998

§ 102(e) Date: Aug. 17, 1998

[87] PCT Pub. No.: WO97/23304

PCT Pub. Date: Jul. 3, 1997

[30] Foreign Application Priority Data

Dec. 22, 1995 [FR] France ..... 95 15320

[51] Int. Cl.[7] ..... B05B 11/00

[52] U.S. Cl. ..... 222/321.2; 222/287; 222/309; 239/333

[58] Field of Search ..... 222/285–287, 222/309, 321.1, 321.2, 321.5, 321.7–321.9, 380; 239/333

[56] References Cited

U.S. PATENT DOCUMENTS

| | | | |
|---|---|---|---|
| Re. 28,366 | 3/1975 | Pechstein | 239/333 |
| 3,216,624 | 11/1965 | Corsette . | |
| 4,111,367 | 9/1978 | Hayes | 239/333 |
| 4,154,374 | 5/1979 | Kirk | 222/321 |
| 4,174,056 | 11/1979 | Loeffler | 222/321 |
| 4,984,702 | 1/1991 | Pierpont | 215/272 |
| 5,192,006 | 3/1993 | Van Brocklin et al. | 222/321 |
| 5,566,865 | 10/1996 | Jouillat et al. | 222/287 |
| 5,655,688 | 8/1997 | Moore | 222/321.2 |
| 5,657,930 | 8/1997 | Battegazzore | 239/333 |
| 5,697,530 | 12/1997 | Montaner et al. | 222/321.2 |
| 5,803,318 | 9/1998 | Lina | 222/321.2 |

FOREIGN PATENT DOCUMENTS

| | | |
|---|---|---|
| 0 145 155 | 6/1985 | European Pat. Off. . |
| 0 669 167 | 1/1995 | European Pat. Off. . |
| 0 274 620 | 7/1998 | European Pat. Off. . |
| 2346056 | 10/1977 | France . |
| 2714119 | 6/1995 | France . |

OTHER PUBLICATIONS

International Search Report from PCT/FR96/10895 in the French language.

International Search Report from PCT/FR96/10895 in the English language.

French Search Report "Rapport de Recherche Preliminaire" for FR 95.15320.

*Primary Examiner*—J. Casimer Jacyna
*Attorney, Agent, or Firm*—Rockey, Milnamow & Katz, Ltd.

[57] ABSTRACT

Precompression pump intended to dispense selectively a product contained in a container, said pump comprising a pump chamber (3) having an inlet valve (4), a piston (1) sliding in a first cylinder (2), a differential piston (5) forming an outlet valve of said pump chamber (3) and sliding in a second cylinder (11) between a closing position and an opening position of the pump chamber (3), said pump comprising also a pusher (6) provided with a dispensing orifice (7), said pusher element (6) being movable between a rest position and a pump actuation position, the pump being characterized in that said first and second cylinders (2 and 11) are directly formed by first and second respective internal walls of said pusher (6), the latter delimiting partially said pump chamber (3), the pump being also characterized in that it comprises only one spring (15) bearing on one side on a portion of the pusher (6) and on the other side on a portion of the differential piston (5), said spring (15) acting on the one hand as a return spring for the pusher (6) towards its rest position and on the other hand as a precompression spring for the differential piston (5).

9 Claims, 2 Drawing Sheets

PRECOMPRESSION PUMP FORMED WITHIN THE PUSHER ELEMENT

BACKGROUND OF THE INVENTION

The present invention concerns a device for dispensing a product held in a container, and more specifically a precompression pump.

The present pumps generally comprise a pump body having a pump chamber, an inlet valve, an outlet valve, a piston sliding in said pump body and an actuating shaft in order to activate the pump by means of a pusher. A return spring acting on the actuating shaft and/or on the pusher, returns the pump to its rest position after each actuation.

The present precompression pumps generally comprise in addition a differential piston forming an outlet valve and sliding in the pump body or on the actuating shaft, under the effect of a precompression spring.

Such a known precompression pump is revealed in document FR-2 346 056.

These known precompression pumps, even though they operate correctly, present a certain number of drawbacks. In fact, they contain numerous parts and are therefore difficult to manufacture and complicated to assemble. Furthermore, their dimensions, in particular their height, are quite considerable, which can represent a disadvantage from the point of view of adaptability on small containers, from the point of view of stocking or from an esthetic viewpoint. Besides, they do not comprise simple means and which do not involve increased manufacturing cost, which permit adjustment of the volume of the product dose discharged each time the pump is actuated.

BRIEF SUMMARY OF THE INVENTION

The objective of the present invention is to provide an improved precompression pump, which does not present the above mentioned drawbacks.

The objective of the present invention is to embody a new precompression pump formed by fewer parts than the present pumps, and consequently less expensive to manufacture and simpler to assemble. Specifically, the objective of the present invention is to provide such a pump comprising only one single spring and not comprising an actuating shaft.

The present invention also aims to provide a new precompression pump the height of which is reduced. Specifically, the objective of the invention is to supply such a pump in which the dead volume is minimized.

Another objective of the invention is to provide such an improved precompression pump where the volume of the dose discharged with each actuation can be modified by the user, without increasing the manufacturing costs.

Consequently, the objective of the invention is a precompression pump to dispense selectively a product held in a container, said pump comprising a pump chamber having an inlet valve, a piston sliding in a first cylinder, a differential piston forming an outlet valve of said pump chamber and sliding in a second cylinder between a closing position and an opening position of the pump chamber, said pump comprising in addition a pusher having a dispensing hole, said pusher element being movable between a rest position and a pump actuating position, characterized in that the said first and second cylinders are directly formed by the first and second inner walls respectively, of said pusher, said pusher thus delimiting said pump chamber in part, and in that said pump only comprises one single spring resting on the one hand on a portion of the pusher and on the other on a portion of the differential piston, said spring acting on the one hand as return spring of the pusher toward its rest position, and on the other as precompression spring for the differential piston.

Thus, the pump according to the invention offers the advantage of eliminating in particular the actuating shaft and one of the two return and precompression springs. The height of the pump and the dead volume are therefore considerably reduced, the pump chamber and the single spring being located inside the pusher, and the number of component parts of the pump is reduced, so that its manufacturing and assembly are more economical, both from a point of view of time and from the point of view of cost.

Said piston is preferably fixed with regard to the container.

Advantageously, said pump comprises a fixed part intended to be attached to the neck of the container, said fixed part delimiting the pump chamber in part and incorporating said piston, said pusher sliding tightly on said fixed part.

In particular, said fixed part also forms the seat of said inlet valve of the pump chamber, said fixed piston being formed by a ring-shaped lip of said fixed part sliding tightly in said first cylinder of said pusher.

Advantageously, said fixed part comprises additionally means to affix the pump to the neck of the container. Thus, the use of a detachable attachment ring is eliminated, which still reduces the number of component parts of the pump even further.

Advantageously, said means of affixing the pump to the neck of the container are small snap-on hooks intended to snap onto said neck of the container and work together after they snap-on with a collar which is intended to be mounted around said hooks in order to keep said fixed part tightly on the neck.

Preferably, said collar, after its mounting onto the fixed part, works together at its upper end with the pusher in order to form a stop defining the rest position of said pusher.

Advantageously, said collar, after its mounting on said fixed part, is movable with regard to the latter between two limit positions in order to define at least two different pump chamber volumes. The user can thus regulate at will the volume of the product dose which will be discharged with each actuation.

Specifically, the mounting and/or the shifting of said collar on said fixed part is done by screwing.

BRIEF DESCRIPTION OF THE DRAWINGS

Other features and advantages of the invention will appear in the course of the following detailed description, given by way of non exhaustive examples with regard to the attached drawings, where.

DETAILED DESCRIPTION OF THE INVENTION

Figure 1:
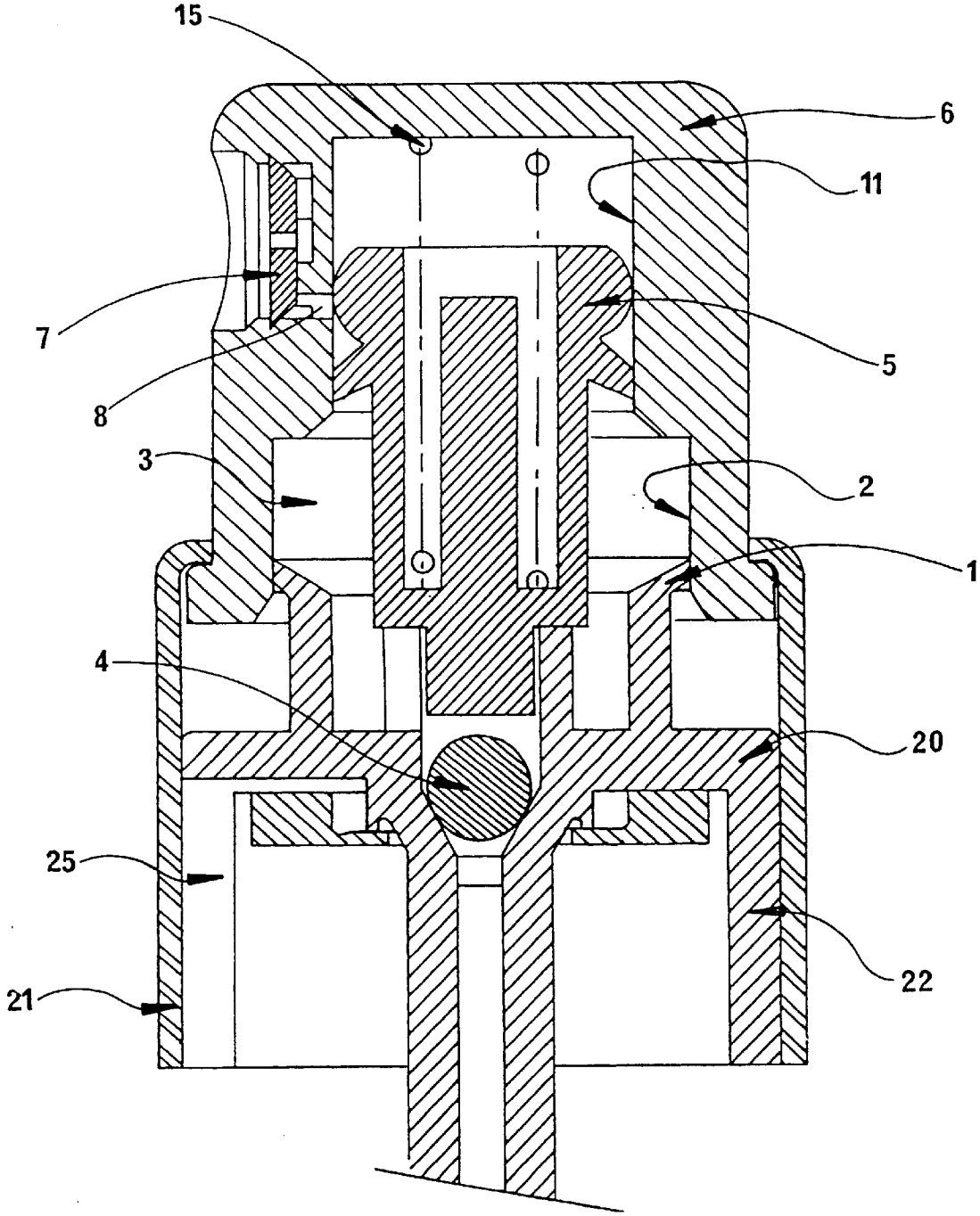
FIG. 1 is a schematic cross-section view of a precompression pump according to the invention, in its rest position.

With reference to the Figures, the precompression pump according to the invention comprises a piston 1 which slides in a first cylinder 2 formed directly in pusher 6. Likewise, the pump comprises a differential piston 5, assuring the precompression and sliding in a second cylinder 11 also formed directly in pusher 6. Pump chamber 3 is therefore partially located inside pusher 6.

Piston 1 is preferably fixed and advantageously forms an integral part of a fixed part 20 which is being attached to the neck of the container (not illustrated), for example by means of snap-in hooks 22 and a collar 21, which is being mounted around said hooks 22. This fixed part 20 therefore necessarily forms part of a portion of the pump body by delimiting pump chamber 3 in part, and by receiving for example a ball bearing 4 to form its inlet valve. On the other hand, fixed part 20 forms, by means of a ring-shaped lip, piston 1. Besides, it also acts advantageously as attachment ring.

According to the invention, said ring-shaped lip forming piston I slides tightly in said first cylinder 2 formed directly by an inner wall of pusher 6. Likewise, differential piston 5 slides in said second cylinder 11 formed directly by an inner wall of pusher 6, between a closing position, where it seals passage 8 between pump chamber 3 and dispensing hole 7, e.g. a nozzle, and an opening position, where it opens said passage 8. One single spring 15, which is supported on the one hand on an inner wall of pusher 6, and on the other hand on said differential piston 5, acts upon pusher 6 toward its rest position and differential piston 5 toward it closing position. Said spring 15 thus acts at the same time as return spring and as precompression spring for the pump according to the invention. Thus, when the user presses down on pusher 6, the latter slides on said fixed part 20 at the level of piston 1. The product contained in dispensing chamber 3 being incompressible, a surge pressure is produced in said chamber 3, which urges said differential piston 5, against the thrust of said spring 15, toward the opening position. As passage 8 is released, the product contained in chamber 3 is discharged via nozzle 7. Then pusher 6 is released and spring 15 returns it toward its rest position, as well as differential piston 5 toward its closing position. Simultaneously, the inlet valve 4 is opened by the vacuum forming in pump chamber 3 and the latter is again filled with product from the container (not illustrated), a vent hole 25 being provided to this effect.

The pump according to the invention thus presents the advantage of operating in the same manner as a classical pump, while incorporating fewer component parts. Furthermore, due to the absence of an actuating shaft, the height of the pump is considerably reduced. On the other hand, single spring 15 of the pump located in the pusher minimizes the dead volume in the pump.

Collar 21, once mounted on fixed part 20 to keep it tightly affixed to the container neck, works together advantageously with pusher 6 in order to form a stop determining the rest position of said pusher.

Figure 2:
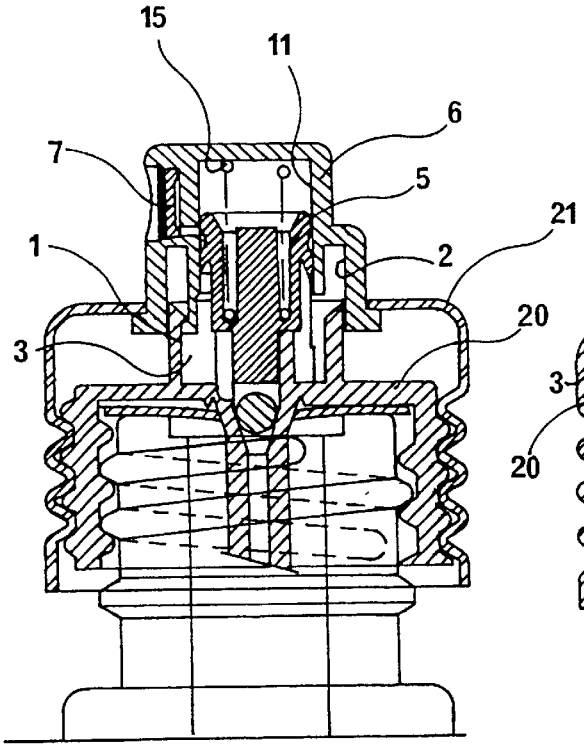
FIGS. 2 and 3 are schematic views similar to FIG. 1, representing a variant of the invention incorporating a collar permitting adjustment of the volume of the product dose discharged.
Figure 3:
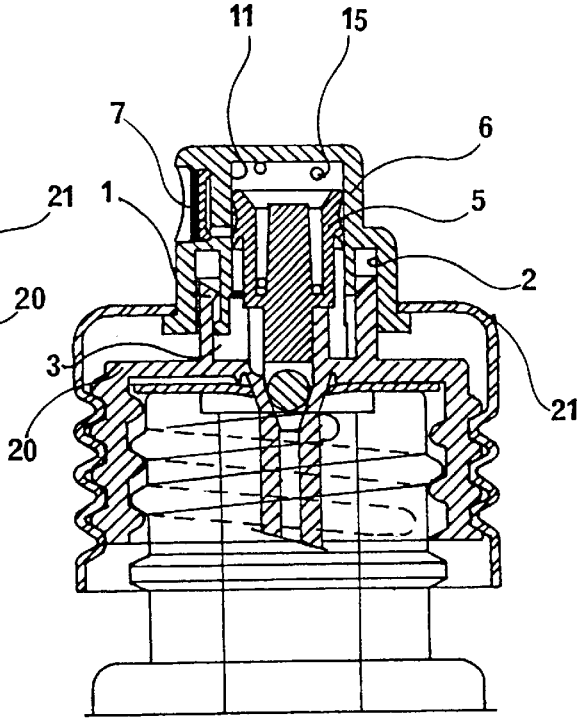

Advantageously, as represented in FIGS. 2 and 3, collar 21 can be shifted with regard to fixed part 20, after having been mounted onto it. Thus, the rest position of the piston and therefore the volume of pump chamber 3 can be modified or adjusted by the user. Specifically, collar 21 can be shifted by screwing between two limit positions represented by FIGS. 2 and 3, but any other known means of shifting the position of collar 21 with regard to fixed part 20 is conceivable (e.g. axial displacement).

We claim:

1. Precompression pump to dispense selectively a product held in a container, said pump comprising a pump chamber (3) having an inlet valve (4), a piston (1) sliding in a first cylinder (2), a differential piston (5) forming an outlet valve of said pump chamber (3), and sliding in a second cylinder (11) between a closing position and an opening position of the pump chamber (3), said pump comprising in addition a pusher (6) having a dispensing hole (7), said pusher (6) being movable between a rest position and an actuating position of the pump, characterized in that said first and second cylinders (2) and (11) are directly formed by the first and second inner walls respectively of said pusher (6), said pusher (6) thus delimiting in part said pump chamber (3), and in that said pump includes only one single spring (5) resting on the one hand on a part of pusher (6) and on the other hand on a part of differential piston (5), said spring (15) acting on the one hand as return spring of pusher (6) toward its rest position, and on the other hand as precompression spring for the differential piston (5).

2. Precompression pump according to claim 1 in which said piston (1) is fixed with regard to the container.

3. Precompression pump according to claim 2, in which said pump comprises a fixed part (20) intended to be attached to the neck of the container, said fixed part (20) delimiting in part pump chamber (3) and incorporating said piston (1), said pusher (6) sliding tightly on said fixed part (20).

4. Precompression pump according to claim 3, in which said fixed part (20) forms also the seat of said inlet valve (4) of pump chamber (3), said fixed piston (1) being formed by a ring-shaped lip (1) of said fixed part (20) sliding tightly in said first cylinder (11) of said pusher (6).

5. Precompression pump according to claim 3 or 4, in which said fixed part (20) comprises in addition means of attachment (22) of the pump to the neck of the container.

6. Precompression pump according to claim 5, in which said attachment means of the pump to the neck of the container are snap-on hooks (22) intended to snap onto said neck of the container, and working together after their snap-on with a collar (21) which is intended to be mounted around said hooks (22) in order to secure said fixed part (20) tightly to the neck.

7. Precompression pump according to claim 6, in which said collar (21), after installing it on fixed part (20), works together at its top end with the pusher (6) in order to form a stop defining the rest position of said pusher (6).

8. Precompression pump according to claim 7, in which said collar (21), after its installation on said fixed collar (20), can be shifted with regard to the latter between two limit positions in order to define at least two different pump chamber (3) volumes.

9. Precompression pump according to claim 8, in which the installation and/or shifting of said collar (21) on said fixed part (20) is done by screwing.

* * * * *